US012497798B1

(12) United States Patent
Zhang

(10) Patent No.: US 12,497,798 B1
(45) Date of Patent: Dec. 16, 2025

(54) REINFORCEMENT ASSEMBLY FOR TENT FRAME AND THE TENT FRAME

(71) Applicant: SANNWSG INC, Dover, DE (US)

(72) Inventor: Qingyun Zhang, Dover, DE (US)

(73) Assignee: SANNWSG INC, Dover, DE (US)

( * ) Notice: Subject to any disclaimer, the term of this patent is extended or adjusted under 35 U.S.C. 154(b) by 0 days.

(21) Appl. No.: 19/303,468

(22) Filed: Aug. 19, 2025

(51) Int. Cl.
*E04H 15/50* (2006.01)

(52) U.S. Cl.
CPC ..... *E04H 15/50* (2013.01)

(58) Field of Classification Search
CPC ..... E04H 15/50
See application file for complete search history.

(56) References Cited

U.S. PATENT DOCUMENTS 2,716,992 A * 9/1955 Campfield ..... E04H 15/60 52/63
3,810,481 A * 5/1974 Nohmura ..... E04H 15/04 135/120.3
4,947,884 A * 8/1990 Lynch ..... E04H 15/50 52/109
5,274,980 A * 1/1994 Zeigler ..... E04H 15/50 52/646
5,444,946 A * 8/1995 Zeigler ..... E04H 15/50 135/147
5,485,863 A * 1/1996 Carter ..... E04H 15/50 135/145
5,490,532 A * 2/1996 Mallookis ..... E04H 15/50 52/109
5,490,533 A * 2/1996 Carter ..... E04H 15/50 135/159
5,634,483 A * 6/1997 Gwin ..... E04H 15/50 135/117
6,412,507 B1 * 7/2002 Carter ..... E04H 15/50 135/144
9,234,366 B2 * 1/2016 Mallookis ..... E04H 15/50
2005/0194029 A1 * 9/2005 Goldwitz ..... E04H 15/322 135/98
2008/0016817 A1 * 1/2008 Zeigler ..... E04H 15/50 52/646

* cited by examiner

*Primary Examiner* — Noah Chandler Hawk
(74) *Attorney, Agent, or Firm* — Hawaii Patent Services; Nathaniel K. Fedde; Kenton N. Fedde

(57) ABSTRACT

The present disclosure relates to a reinforcement assembly for a tent frame and the tent frame, addressing the issue of instability under rainwater accumulation, strong winds, and complex terrain in existing structures. Through the insertion structure of a central main support rod and an extension rod, a first fastening rope is pre-tensioned by a first spring, connecting the four corner posts to form a vertical tension balance. A second fastening rope is horizontally tensioned between a post and the extension rod to enhance anti-tipping stability. A second spring at the bottom of the extension rod cushions the downward pressure of the canopy. This significantly improves rain load resistance and adaptability to a plurality of scenarios.

20 Claims, 10 Drawing Sheets

REINFORCEMENT ASSEMBLY FOR TENT FRAME AND THE TENT FRAME

TECHNICAL FIELD

The present disclosure relates to the technical field of outdoor tents, particularly to a reinforcement assembly for a tent frame and the tent frame.

BACKGROUND

With the rapid growth of outdoor camping, wilderness exploration, and similar activities, tents, as core temporary shelters, have structural stability directly linked to user safety and experience. However, existing tent frames exhibit significant technical shortcomings in stability, making them poorly suited for complex and variable outdoor environments.

From a usage perspective, the diversity of outdoor terrains presents multifaceted technical challenges for tent frames. Mountainous terrain features pronounced undulations, making it difficult to achieve balanced force distribution at support points, often leading to structural tilting or even collapse due to localized stress concentration. In coastal environments, sustained sea breezes generate periodic alternating loads on the tent fabric, easily causing loosening at joint connections, while traditional structures lack sufficient resistance to such high-frequency alternating impacts. Grassland areas, though flat, face significantly increased gust loads under unobstructed conditions, often resulting in instability due to inadequate anti-overturning performance.

At the structural design level, most existing tent frames employ simple modular frame structures, with stability heavily reliant on the anchoring effect of ground stakes and the pre-tension of guy ropes. In practice, ground stakes struggle to achieve effective anchoring in special ground conditions like sand or permafrost; guy ropes are prone to aging and breaking under prolonged outdoor exposure; and the setup process demands high operational precision, with improper handling easily leading to a marked decline in overall structural stability.

As tents evolve toward larger spaces and multi-person usage scenarios, their support structures' load-bearing capacity and wind resistance have not kept pace, making safety hazards increasingly apparent. The self-weight and wind-exposed area of large tents increase correspondingly, yet existing frame designs for load transfer paths struggle to handle these additional loads.

Under extreme weather conditions, the technical limitations of traditional tent frames become even more pronounced. During heavy rain, water accumulation on the tent surface sharply increases additional loads, often causing plastic deformation in the frame due to overload. In strong winds, the aerodynamic loads on tents grow exponentially, and frames lacking targeted reinforcement designs are ill-equipped to withstand such loads, frequently leading to complete overturning.

SUMMARY

The present disclosure provides a reinforcement assembly for a tent frame and the tent frame to address the issues outlined in the background.

To achieve the above object, the present disclosure adopts the following technical solutions:

A tent frame reinforcement assembly comprises a central main support rod extending vertically, with a first accommodating cavity formed inside; an extension rod slidably inserted into the first accommodating cavity; a plurality of first fastening ropes, each with one end connected to a corner post of the tent frame and the other end extending into the first accommodating cavity and converging for connection; a first elastic member positioned in a convergence area and connected to the extension rod, configured to generate a continuous pre-tension force when the tent frame is deployed, transmitting a tensioning force to the corner posts through the first fastening ropes to enhance frame stability; a plurality of second fastening ropes, each connected between the extension rod and the corner post to form a horizontal tension network; and a second elastic member positioned at a bottom of the first accommodating cavity and abutting against the extension rod, configured to generate an upward return force when the extension rod is pressed downward by an external force from a canopy, dynamically counteracting a downward pressure and inhibiting displacement of the extension rod.

A tent frame comprises at least three corner posts extending longitudinally in a vertical direction; at least three sets of transverse frame beams, each set of transverse frame beams slidably connecting two adjacent corner posts through a sleeve assembly; and a reinforcement assembly, comprising: a central main support rod extending in the vertical direction, with a first accommodating cavity formed inside; and an extension rod slidably inserted into the first accommodating cavity; and a plurality of first fastening ropes, each with one end connected to a corner post of the tent frame and the other end extending into the first accommodating cavity and converging for connection; and a first elastic member positioned in a convergence area and connected to the extension rod, configured to generate a continuous pre-tension force when the tent frame is deployed, transmitting a tensioning force to the corner posts through the first fastening ropes to enhance frame stability; and a plurality of second fastening ropes, each connected between the extension rod and the corner post, forming a horizontal tension network; and a second elastic member positioned at a bottom of the first accommodating cavity and abutting against the extension rod, configured to generate an upward return force when the extension rod is pressed downward by an external force from a canopy, dynamically counteracting a downward pressure and inhibiting displacement of the extension rod. The tent frame further comprises at least three sets of net-like support arms, each set connecting the transverse frame beam and the central main support rod.

The present disclosure has the following beneficial effects compared to the prior art:

Through the insertion structure of the central main support rod and the extension rod, as well as the synergistic effect of the elastic member and the fastening rope, the force balance of the tent frame in complex terrains is effectively improved, preventing tilting or collapse caused by localized stress concentration in scenarios such as mountainous areas. The continuous preload of the first elastic member and the damping function of the second elastic member enhance resistance to periodic alternating loads like sea breezes, reduce the risk of loosening at connection points, and improve anti-tipping performance in open areas like grasslands. The three-dimensional support system formed by the transverse frame beam and the net-like support arm optimizes the load transfer path for large-sized tents, enhancing the bearing capacity for both the canopy's self-weight and wind loads. For extreme weather, the second elastic member dynamically balances additional rainwater accumulation loads to prevent frame overload deformation. The overall structure, with its wear-resistant rope protection and self-locking connection design, reduces issues like aging and breakage of traditional tension ropes, minimizes reliance on setup operations, and significantly improves the stability, safety, and durability of the tent frame.

BRIEF DESCRIPTION OF DRAWINGS

The drawings, which form part of this application, are provided to further illustrate the present disclosure. The illustrative embodiments and the descriptions thereof are intended to explain the present disclosure and do not constitute an undue limitation thereof. In the drawings.

Figure 1:
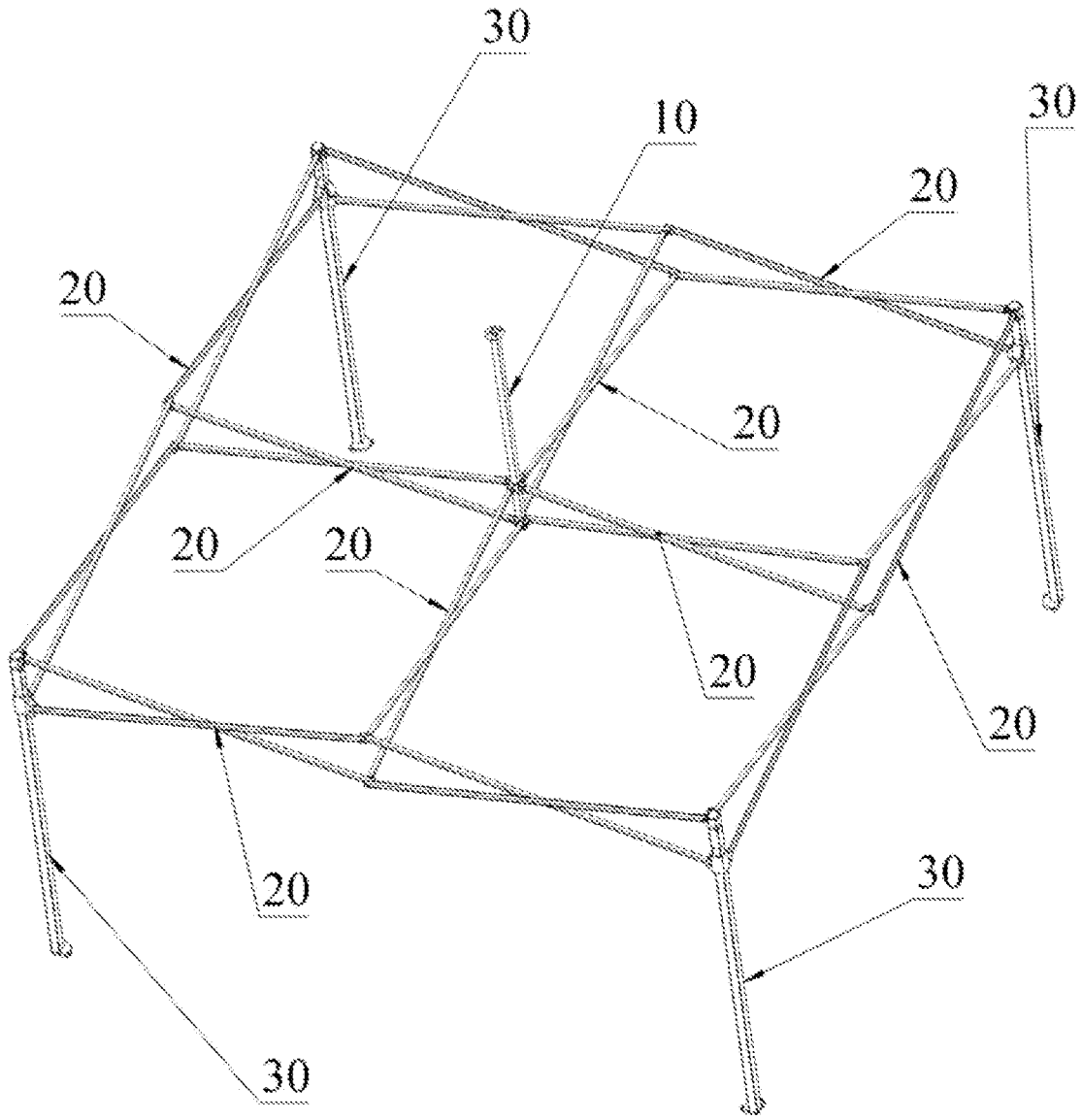
FIG. 1 is a perspective schematic view of a conventional tent frame structure.

Reference signs: Tent frame (100); Corner post (110); Insertion hole (111); Transverse frame beam (120); Net-like support arm (130); Caster (140); Wheel seat (141); Insertion rod (142); Reinforcement assembly (200); Central main support rod (210); First accommodating cavity (211); First mounting base (212); Second mounting base (213); Guide seat (214); Second hanging rod (215); Extension rod (220); Second accommodating cavity (221); First hanging rod (222); Fixed seat (223); First fastening rope (230); First elastic member (240); Second fastening rope (250); Second elastic member (260); Connection seat (270); Through hole (271).

DESCRIPTION OF EMBODIMENTS

The technical solution in the embodiment of the present disclosure will be clearly and completely described below with reference to the drawings. Obviously, the described embodiment is part of, rather than all of the embodiments of the present disclosure. The following description of at least one exemplary embodiment is illustrative in nature and is in no way intended to limit the present disclosure, its application or uses. Based on the embodiments in the present disclosure, all other embodiments obtained by those skilled in the art without creative work belong to the scope of protection of the present disclosure.

It should be noted that the terminology used here is only for describing specific embodiments, and is not intended to limit exemplary embodiments according to the present application. As used herein, the singular form is also intended to include the plural form unless the context clearly indicates otherwise. Furthermore, it should be appreciated that when the terms "comprising" and/or "including" are used in this specification, they specify the presence of features, steps, operations, devices, components and/or combinations thereof.

Unless otherwise specified, the relative arrangement of components and steps, numerical expressions and numerical values set forth in these embodiments do not limit the scope of the present disclosure. At the same time, it should be appreciated that for the convenience of description, the dimensions of various parts shown in the drawings are not drawn according to the actual scale relationship. Techniques, methods and equipment known to those skilled in the art may not be discussed in detail, but in appropriate cases, they should be regarded as part of the authorization specification. In all the examples shown and discussed herein, any specific values should be interpreted as illustrative, and not as limiting. Therefore, other examples of exemplary embodiments may have different values. It should be noted that similar numbers and letters indicate similar items in the following drawings, therefore once an item is defined in one drawing, it does not need to be further discussed in subsequent drawings.

Figure 2:
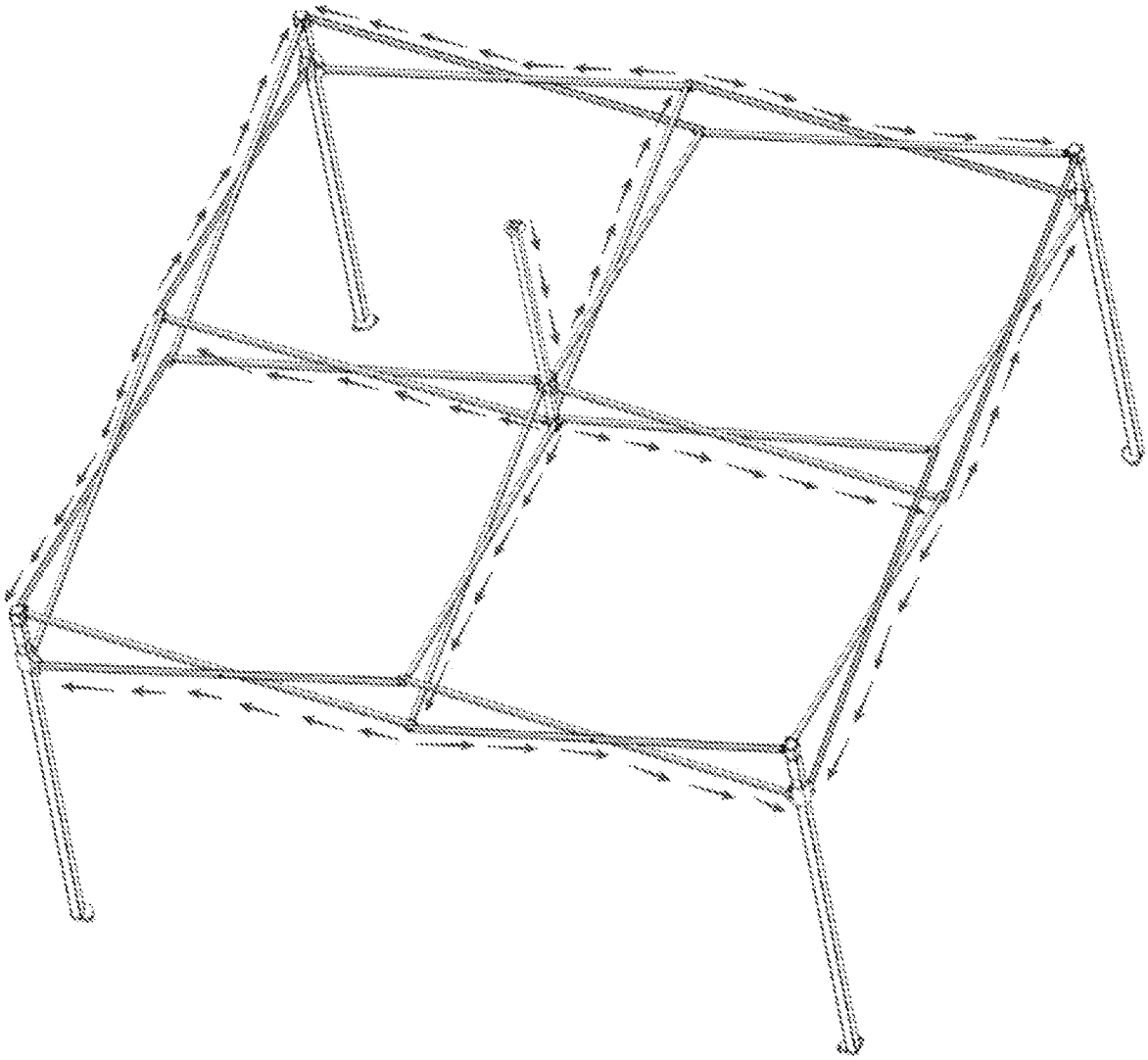
FIG. 2 is a force diagram of the conventional tent frame structure shown in FIG. 1.

As shown in FIGS. 1 and 2, in the structural design of existing tent frames, a central rod 10 is typically installed at the center to enhance top support capacity. During deployment, this central rod 10 continuously bears downward pressure caused by the weight of the canopy, rainwater accumulation, or external loads. In the existing structure, the central rod 10 is indirectly connected to the corner posts 30 through peripheral links 20, causing the downward pressure to be distributed outward through the links 20. Since the central rod 10 is not directly supported by the corner posts 30, most of the pressure concentrates on the links 20 and their connection points, failing to efficiently disperse to the corner posts 30 and transfer to the ground for effective support. This imbalanced force distribution makes the central rod 10 and links 20 prone to bending deformation due to overload, while connection points are susceptible to loosening or even fracturing, ultimately leading to instability of the entire tent frame structure and, in severe cases, collapse risks.

In the present disclosure, addressing the issues in the prior art where rainwater tends to accumulate on the tent fabric during rainy weather, causing a sharp increase in load-bearing pressure that leads to frame deformation or even collapse, as well as problems such as uneven force distribution and loose connections in scenarios like complex terrain or strong winds, a reinforcement assembly for a tent frame and the tent frame are provided. This reinforcement assembly utilizes a plug-in structure between the main support rod and the extension rod, in conjunction with a first spring to provide tension for the first rope, a second spring to enable elastic movement of the extension rod, and a second rope to form a net-like support. This design balances forces, buffers pulling forces, enhances frame strength, and dynamically dissipates stress, effectively resolving load-bearing issues caused by rainwater accumulation and stability deficiencies in various scenarios. Below, the reinforcement assembly for a tent frame and the embodiments of the tent frame according to the present disclosure are described in detail with reference to the accompanying drawings.

Figure 3:
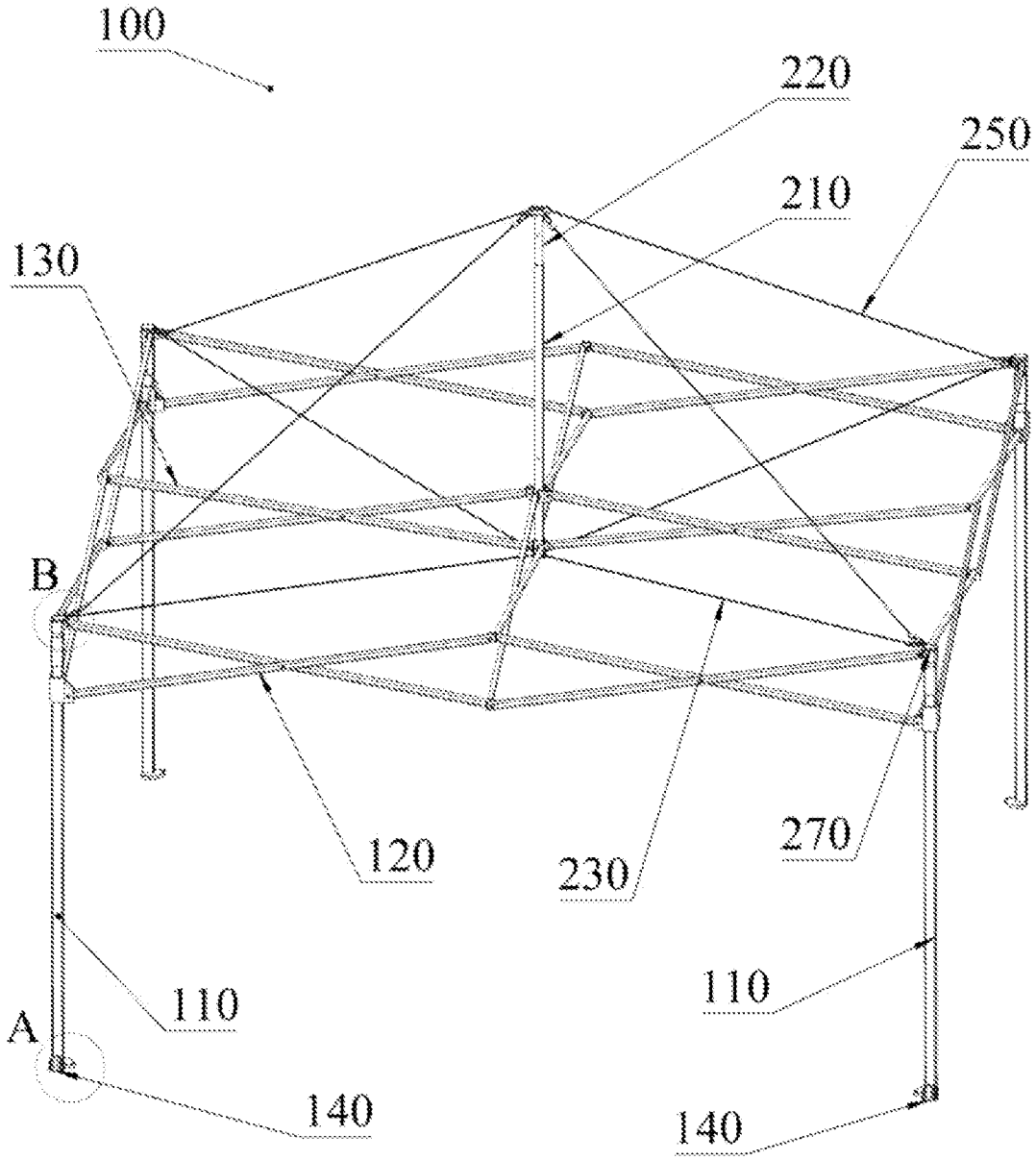
FIG. 3 is a perspective schematic view of an embodiment provided by the present disclosure.
Figure 6:
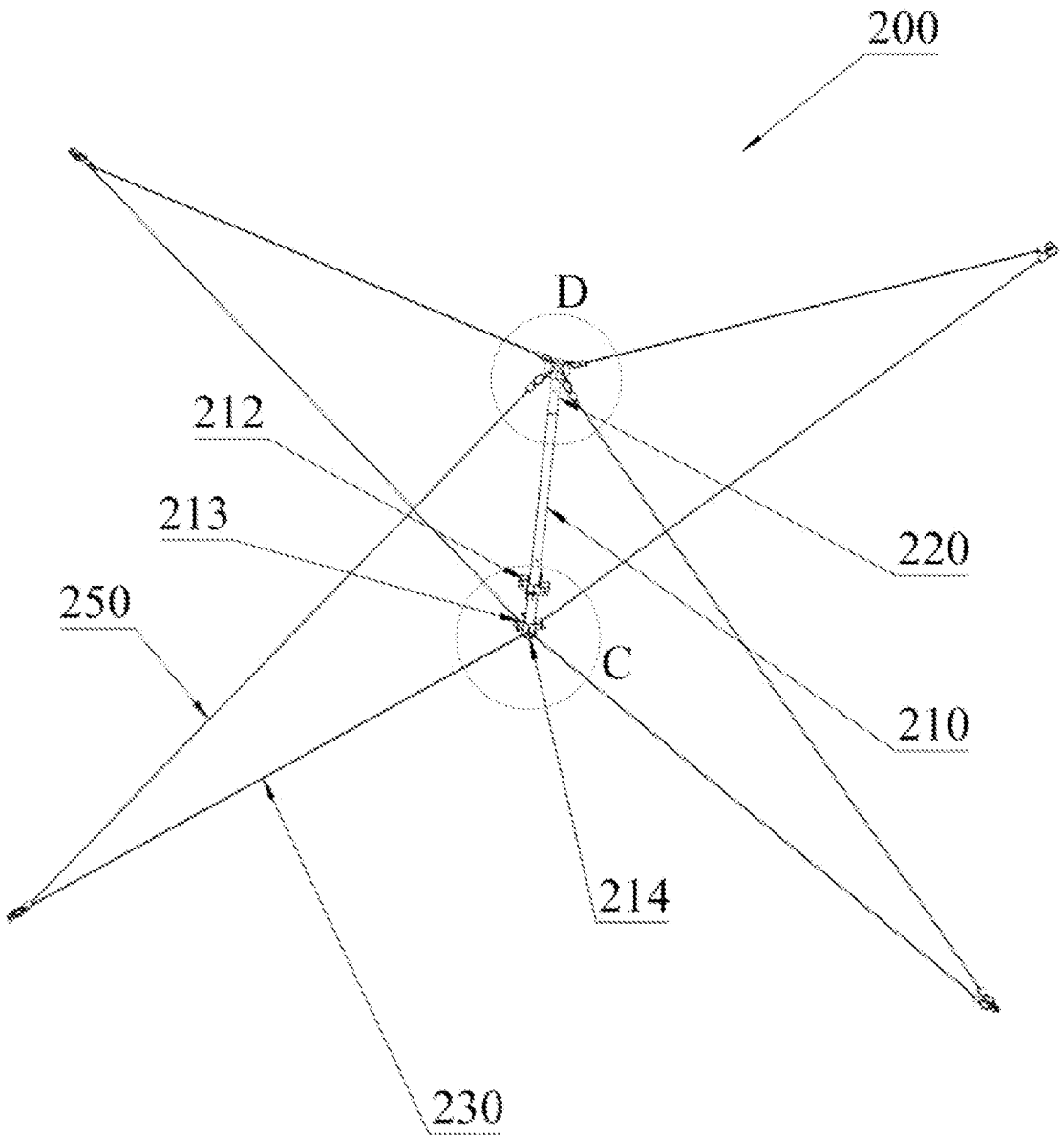
FIG. 6 is a perspective schematic view of the reinforcement assembly in the embodiment shown in FIG. 3.

As shown in FIGS. 3 and 6, this embodiment provides a reinforcement assembly for a tent frame and the tent frame. The tent frame 100 is configured as a square frame structure, including corner posts 110, transverse frame beams 120, and net-like support arms 130. The reinforcement assembly 200 is installed at the center of the tent frame and fixedly connected to the net-like support arms 130 through a bolt structure. In the preferred embodiment, there are four corner posts 110, each positioned at one of the four corners of the tent frame 100 and configured as square support rods extending vertically. When the tent frame 100 is deployed for use, the corner posts 110 expand outward to the four corners. Adjacent corner posts 110 are connected by a set of transverse frame beams 120, with each of the four sets of transverse frame beams 120 configured as foldable curved rods. The connecting ends of the transverse frame beams 120 can move axially up and down along the corner posts 110 through a slidable sleeve assembly, enabling the tent frame to be folded for storage or deployed for use. In the unfolded operational state, these connecting ends are axially positioned along the corner posts 110 by a snap-fit structure, stably maintaining a fixed position. The connecting ends refer to the ends of the transverse frame beams 120 fixed to the corner posts 110.

Figure 4:
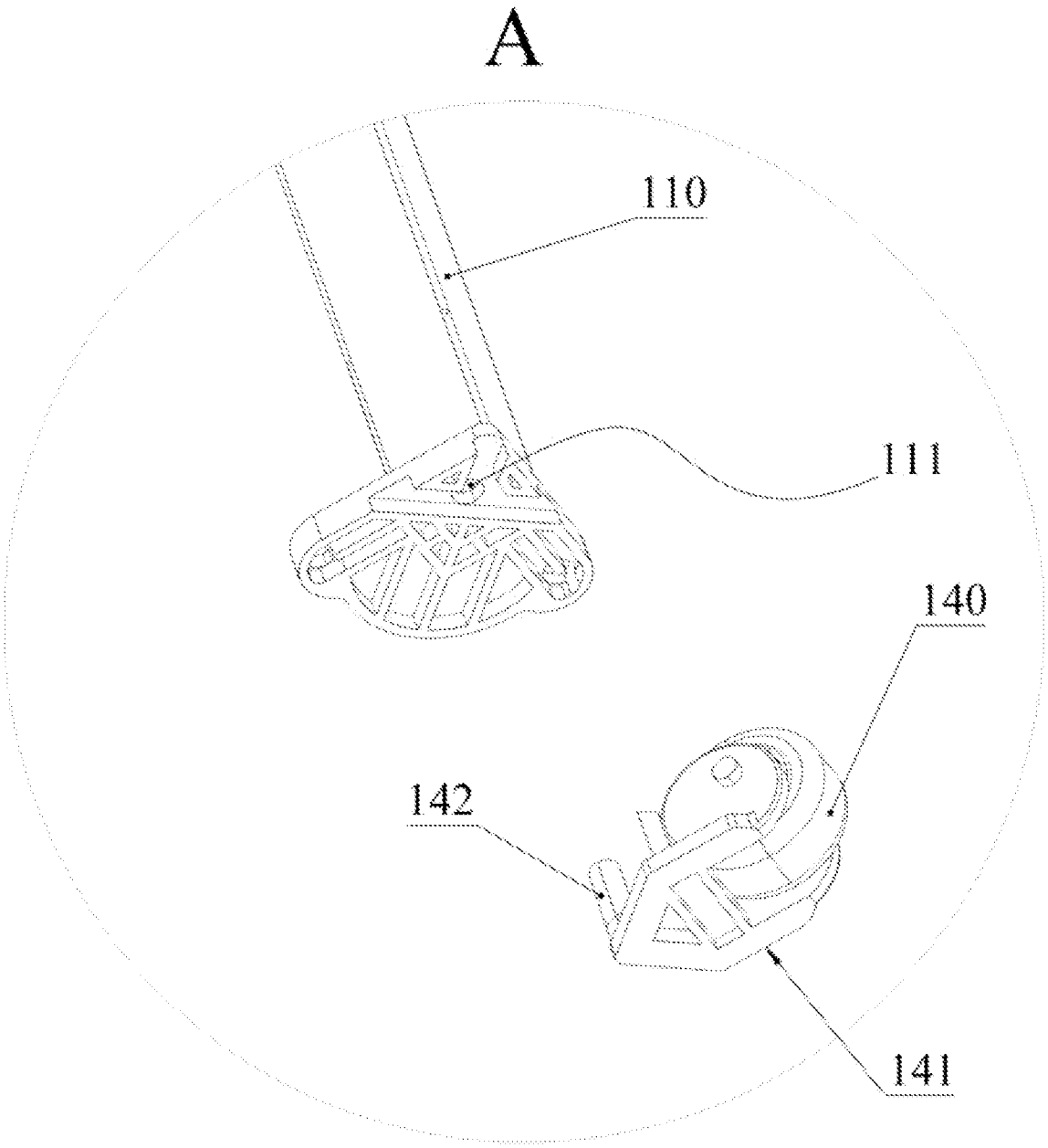
FIG. 4 is a partial exploded view of the embodiment shown in FIG. 3.

In a preferred embodiment of the present disclosure, referring to FIGS. 3 and 4, two adjacent corner posts 110 are equipped with casters 140 at their bottom ends. The casters 140 are secured to the corner posts 110 through bolt structures. Specifically, the bottom end of the corner post 110 features an insertion hole 111, while the caster 140 is configured with a wheel seat 141. The wheel seat 141 is integrally formed with an insertion rod 142. The caster 140 and wheel seat 141 are fixedly connected through the bolt structure, and the insertion rod 142 is inserted into the insertion hole 111 of the corner post 110 to form a secure attachment. When the tent frame is in the storage state, the rolling feature of the casters 140 provides translational freedom, allowing users to push and adjust its position easily, thereby enhancing the convenience of storage operations.

In a further embodiment, to improve the anchoring effect of the tent frame on soft or low-friction surfaces (such as sand, snow, or frozen ground), the bottom end of the corner post 110 can optionally be equipped with an anchor claw structure or a ground-assist pressure plate. The anchor claw structure includes deployable multi-pronged spikes, which can be manually or automatically extended to increase contact area and friction with the ground. The pressure plate structure, secured to the corner post through screws or clamping mechanisms, presses down on surface snow or loose soil, enhancing overall pull-out resistance and significantly improving the frame's anti-tipping capability.

Figure 10:
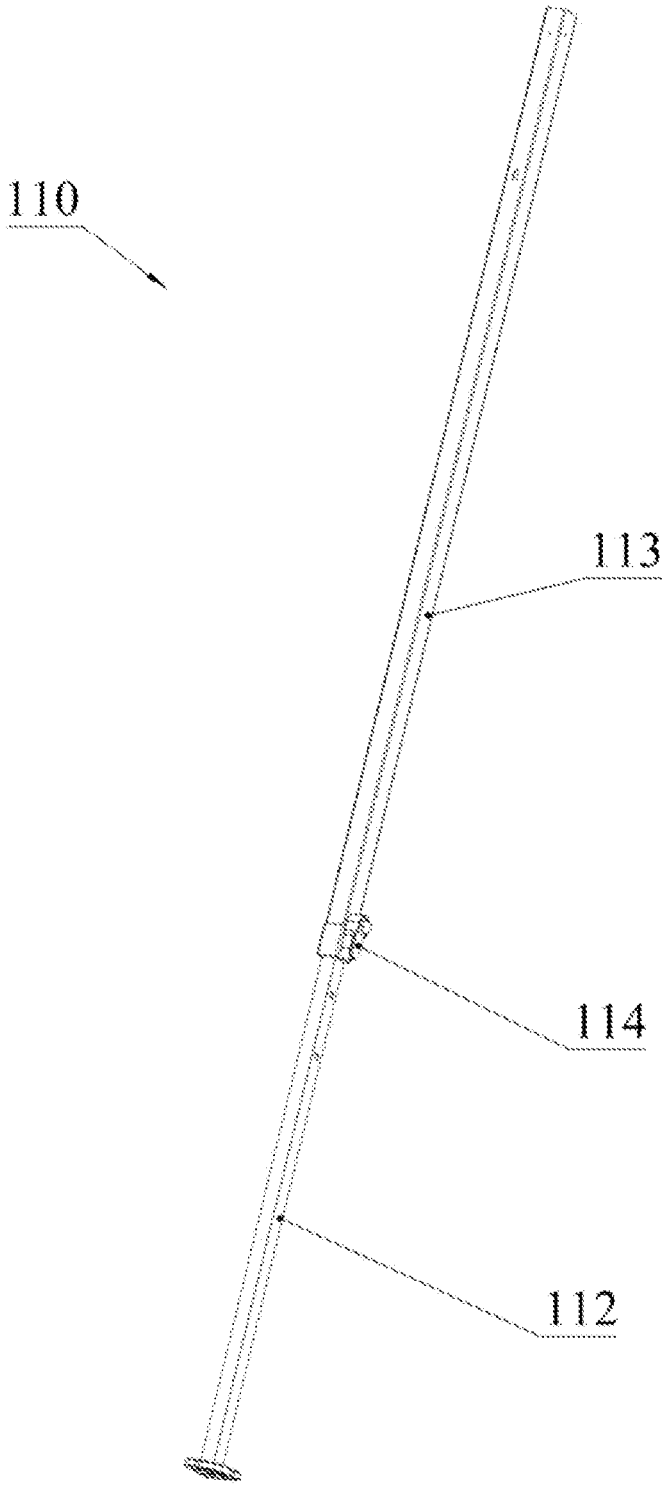
FIG. 10 is a perspective schematic view of another embodiment of the corner post provided by the present disclosure.

In other embodiments (as shown in FIG. 10), the corner post 110 can be designed as a telescopic tube structure. This telescopic tube structure includes an inner tube 112 and an outer tube 113 slidably nested together, along with a locking mechanism 114 (such as a pin, snap, or knob). By adjusting the extension length of the inner tube 112 relative to the outer tube 113, the overall height of the corner post 110 can be modified. The locking mechanism 114 secures the inner tube 112 and the outer tube 113 at the selected length positions, providing stable support and adaptability to varying terrain slopes.

Referring further to FIG. 3, the net-like support arm 130 is configured as a foldable curved rod, sharing the same shape as the transverse frame beam 120. One end of the net-like support arm 130 is fixedly connected to the reinforcement assembly 200 through a bolt structure, while the other end is connected to the transverse frame beam 120 through another bolt structure. Preferably, four sets of net-like support arms 130 are provided, with each transverse frame beam 120 linked to the reinforcement assembly 200 through one set of net-like support arms 130. This connection structure allows the reinforcement assembly 200 to automatically adjust its position in response to the unfolding or folding state of tent frame 100.

In other embodiments (not shown), the corner posts 110, the transverse frame beams 120, and the net-like support arms 130 are not limited to the square rods and curved rods in the aforementioned preferred embodiments. They can also be configured as cylindrical support rods, triangular support rods, rounded rectangular column support rods, or any other desired shape.

In other embodiments (not shown), the tent frame 100 includes four corner posts 110, four sets of transverse frame beams 120, and four sets of net-like support arms 130, but this is not the only option. For example, the tent frame 100 can be configured as a triangular frame structure: in this case, the corner posts 110 are set to three, arranged at the vertices of a triangle; the transverse frame beams 120 are set to three sets, each connecting the top and sides of two adjacent corner posts 110 to form the edge support skeleton of the triangle; the net-like support arms 130 are correspondingly set to three sets, each independently connecting the reinforcement assembly 200 to a corresponding set of transverse frame beams 120. It can also be configured as a hexagonal frame structure, where the corner posts 110 are set to six, the transverse frame beams 120 to six sets, and the net-like support arms 130 to six sets; or as an octagonal frame structure, with eight corner posts 110, eight sets of transverse frame beams 120, and eight sets of net-like support arms 130. In such polygonal expansion structures, the reinforcement assembly 200 is fixed at the center of the tent frame 100; the number of net-like support arms 130 matches the number of transverse frame beam sets, with each set of net-like support arms 130 independently connecting the reinforcement assembly 200 to a corresponding set of transverse frame beams 120. This ensures the reinforcement assembly 200 remains centrally positioned through the synchronized linkage of a plurality of sets of net-like support arms 130, while adaptively adjusting the force distribution as the frame shape changes.

Figure 8:
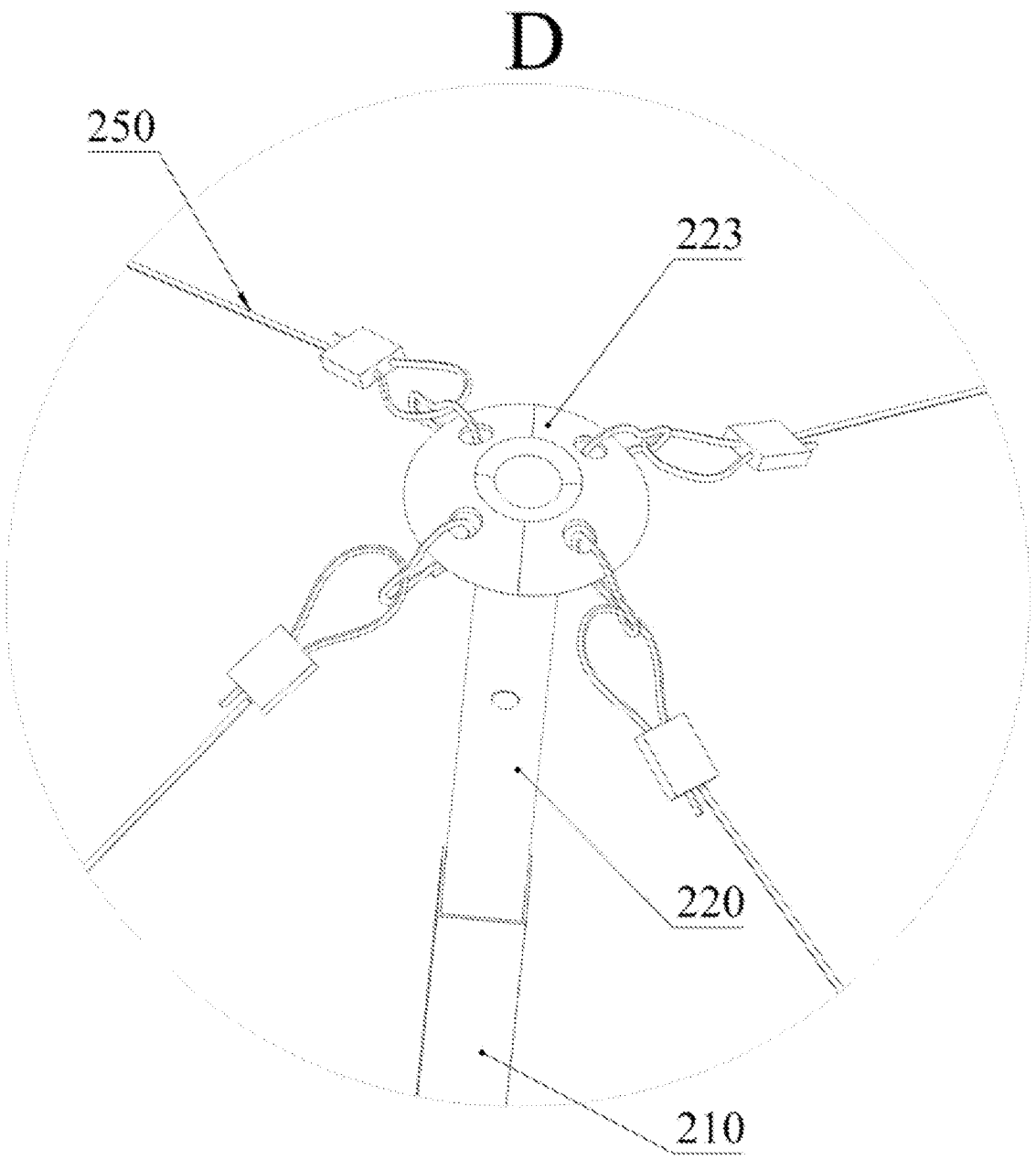
FIG. 8 is another partial schematic view of the embodiment shown in FIG. 6.
Figure 9:
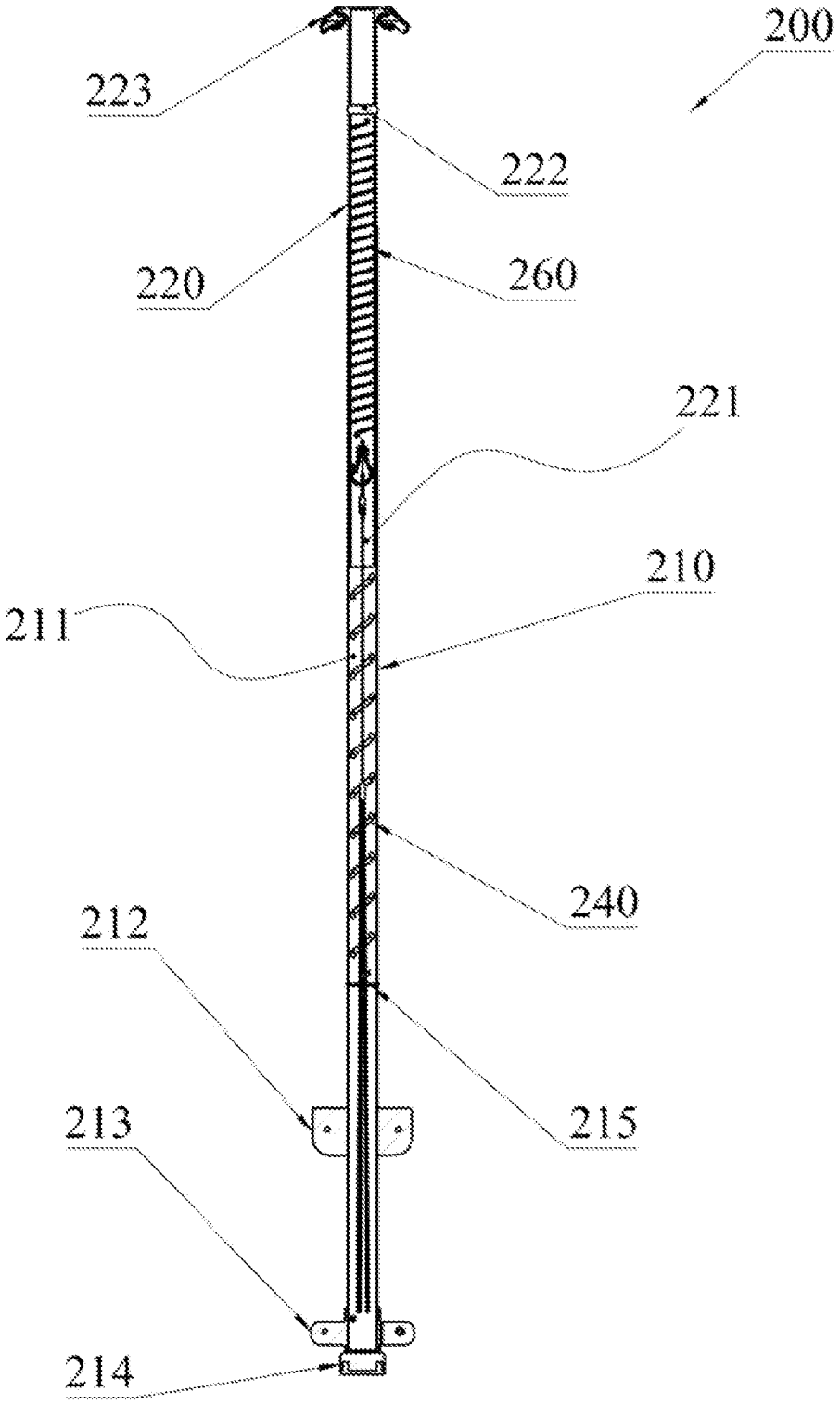
FIG. 9 is a cross-sectional view of the embodiment shown in FIG. 6.

As shown in FIGS. 6, 8, and 9, the reinforcement assembly 200 includes a central main support rod 210 and an extension rod 220. The central main support rod 210 is positioned at the center of the tent frame 100 and is configured as a square hollow tube extending vertically. Its interior forms a first accommodating cavity 211. The extension rod 220 is configured as a cylindrical hollow tube extending vertically, with its interior forming a second accommodating cavity 221. The extension rod 220 is coaxially arranged above the central main support rod 210 and slidably inserted into the first accommodating cavity 211.

Figure 7:
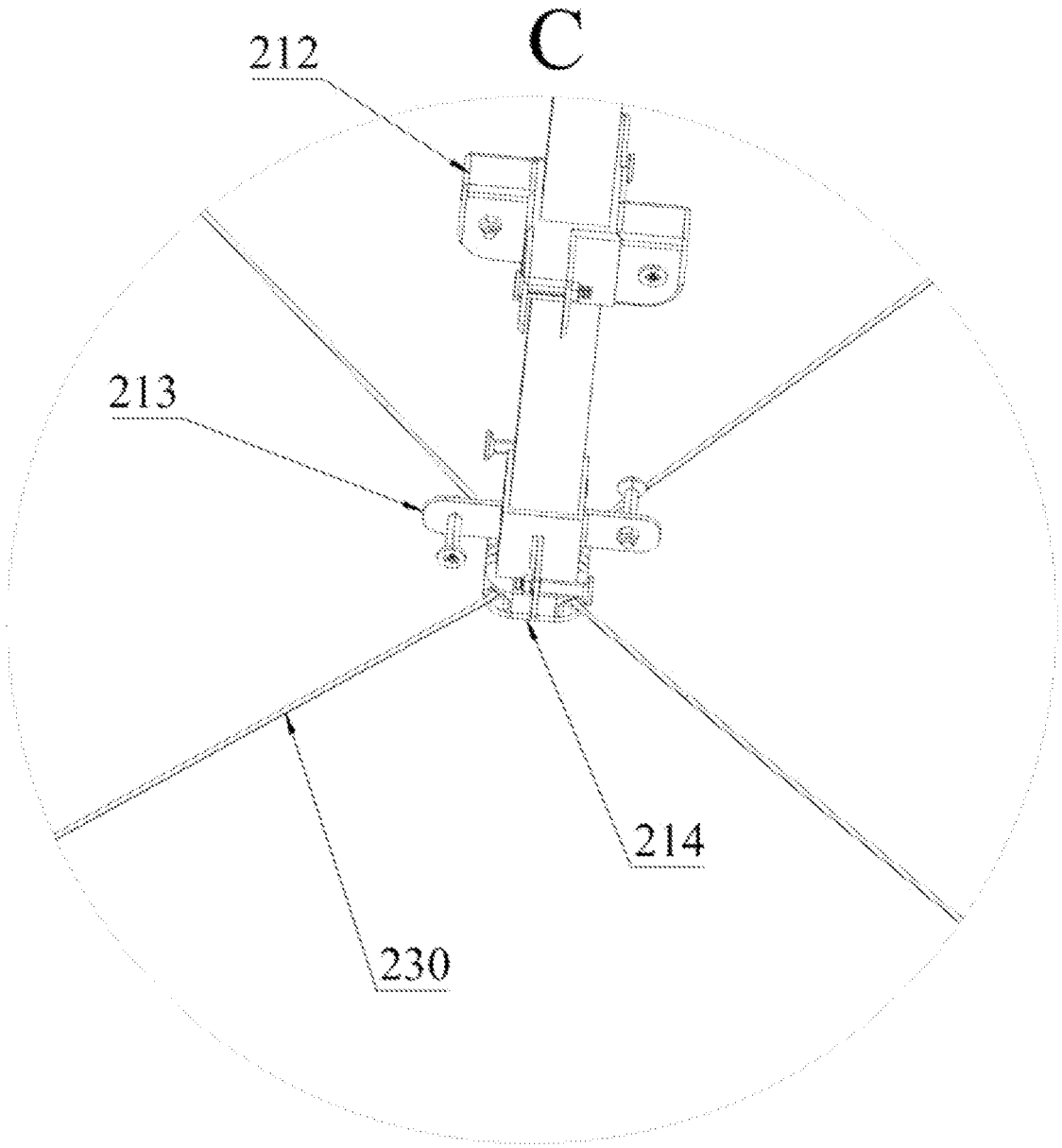
FIG. 7 is a partial schematic view of the embodiment shown in FIG. 6.

Referring to FIG. 7, the outer surface of the central main support rod 210 is sleeved with a first mounting base 212 and a second mounting base 213. The first mounting base 212 is slidably arranged on the outer surface of the central main support rod 210. When the tent frame 100 is in the unfolded operational state, the first mounting base 212 is positioned at the lower part of the central main support rod 210. When the tent frame 100 is gradually folded from the unfolded state to the storage state, the first mounting base 212 slides upward along the outer surface of the central main support rod 210 and eventually moves to the top end of the central main support rod 210, completing the transition to the storage state. The second mounting base 213 is fixedly embedded at the bottom of the central main support rod 210. Both the first mounting base 212 and the second mounting base 213 are formed with four mounting hole positions, which are used to accommodate the ends of the net-like support arm 130 and are fixedly connected through a bolt structure. The net-like support arm 130 can rotate around its connection axis with the first mounting base 212 and the second mounting base 213.

Figure 5:
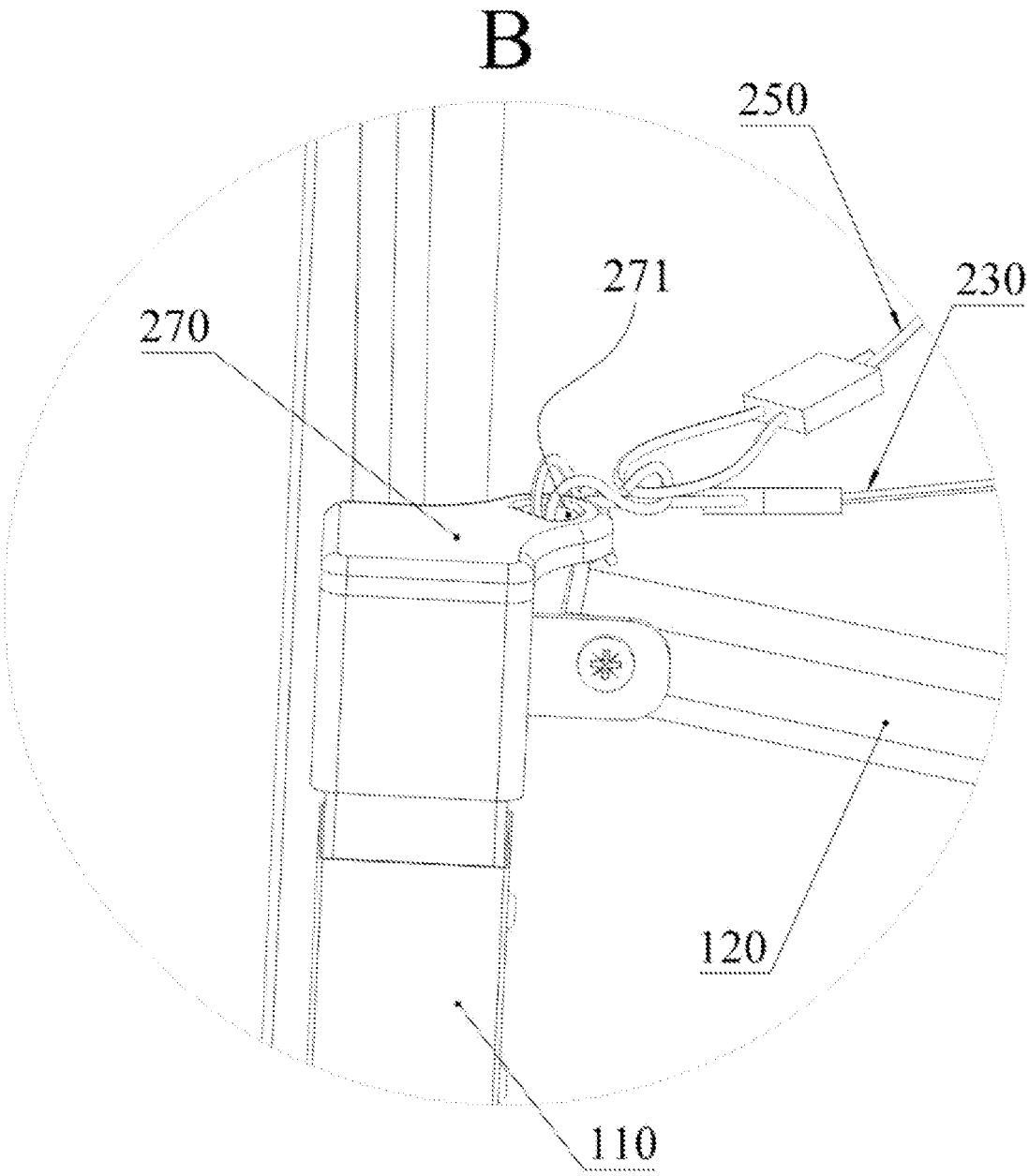
FIG. 5 is another partial exploded view of the embodiment shown in FIG. 3.

Please refer to FIGS. 6 and 9. The reinforcement assembly 200 includes a first fastening rope 230, a first elastic member 240, a second fastening rope 250, and a second elastic member 260. In the preferred embodiment of the present disclosure, there are four first fastening ropes 230. Accordingly, the reinforcement assembly 200 also includes four connection seats 270 (see FIG. 5). The four connection seats 270 are respectively fixedly embedded at the top ends of the corner posts 110. Each connection seat 270 is provided with through holes 271, which are used to secure one end of the first fastening rope 230 and one end of the second fastening rope 240.

Specifically, one end of the first fastening rope 230 forms a hanging loop and is fixed to the connection seat 270 by passing a hook assembly through the through hole 271. The first fastening rope 230 extends into the first accommodating cavity 211. Inside the first accommodating cavity 211, the four first fastening ropes 230 are first neatly gathered by an integrated convergence block, concentrating their ends to form a unified force-bearing node. This convergence node is then fixedly connected to one end of the first elastic member 240 through the hook assembly.

In the present disclosure, the first fastening rope 230 and the second fastening rope 250 are preferably made of high-strength synthetic fiber materials (such as ultra-high molecular weight polyethylene fiber or aramid fiber). These materials exhibit extremely high tensile strength and excellent fatigue resistance, significantly enhancing the load-bearing capacity and safety of the ropes. In other embodiments, to improve the wear resistance of the ropes during long-term use and extend their service life, the outer surfaces of the first fastening rope 230 and the second fastening rope 250 are both sleeved with wear-resistant protective covers. These protective covers are preferably made of highly wear-resistant materials (such as polyurethane, nylon, or ultra-high molecular weight polyethylene woven layers) and tightly encase the rope bodies, effectively resisting potential friction damage against the guide seat 214 rail, the inner wall of the through hole 271, or other structural components, thereby preventing strength reduction or breakage risks caused by surface wear.

In other embodiments (not shown), to address the risks of rope aging and connection loosening, the hook assembly used to connect the first fastening rope 230 and the second fastening rope 250 can adopt a dual-spring self-locking structure. The hook body features an opening, and when the hook is hooked into the through hole 271 of the connection seat 270, two internally crossed pre-tensioned springs automatically expand, locked onto the inner edge of the through hole 271 to form a mechanical self-lock, effectively preventing detachment caused by wind-induced vibrations or accidental pulling. Additionally, a self-lubricating polymer wear-resistant bushing (such as PTFE or nylon composite) is embedded in the through hole 271 of the connection seat 270. This bushing not only reduces friction wear between the rope loop and the metal hole wall but also provides slight damping in vibrating environments due to its moderate elastic deformation capability, absorbing high-frequency impact energy and protecting the rope ends, thereby significantly extending the lifespan of the connection point.

Referring to FIG. 7, a guide seat 214 is embedded at the bottom opening of the central main support rod 210. This guide seat 214 forms four guide rails, through which the first fastening rope 230 is threaded. The guide seat 214 guides the first fastening rope 230 to extend toward the corner post 110 and restricts any deviation caused by the rope's inherent flexibility, ensuring precise positioning.

As shown in FIGS. 8 and 9, the extension rod 220 is provided with a first hanging rod 222 near its top end. The first hanging rod 222 extends along the radial direction of the extension rod 220 and passes through the second accommodating cavity 221. The top opening of the extension rod 220 is fixedly embedded with a fixed seat 223, which forms four hanging holes. In the present disclosure, the first elastic member 240 and the second elastic member 260 are preferably spring structures. The first elastic member 240 is positioned at the convergence area of the ends of the first fastening ropes 230. One end of the first elastic member 240 is fixedly hung to the first hanging rod 222, while the other end is fixedly connected to the converged first fastening ropes 230 through a hook assembly. When the tent frame 100 is in the unfolded operational state, the first elastic member 240 is in a stretched state, which generates a return force. This return force is transmitted through the first fastening rope 230, maintaining the pre-tension of the first fastening rope 230. The tension force is transmitted to the corner post 110 through the first fastening rope 230 to enhance frame stability, significantly improving the structural robustness of the tent frame 100 in the deployed state.

As shown in FIG. 6, the second fastening rope 250 is connected between the corner post 110 and the extension rod 220, forming a horizontal tension network. Specifically, both ends of the second fastening rope 250 are formed into hanging loops. One end is fixed to the through hole 271 of the connection seat 270 (see FIG. 5) through a hook assembly, while the other end is hung and fixed to the hanging hole of the fixed seat 223 (see FIG. 8) through a hook assembly. When the tent frame 100 is in the unfolded operational state, the corner posts 110 move toward the four corners of the tent frame 100, while the extension rod 220 moves upward along the vertical direction. This movement causes the second fastening rope 250 to be tensioned and maintain pre-tension, thereby improving the structural stability of the tent frame 100 in the deployed state.

Referring to FIG. 9, the second elastic member 260 is installed within the first accommodating cavity 211 of the central main support rod 210. Near the bottom end of the central main support rod 210, a second hanging rod 215 is provided, extending radially along the central main support rod 210 and passing through the first accommodating cavity 211. This second hanging rod 215 is used to secure the bottom end of the second elastic member 260, while the top end of the second elastic member 260 abuts against the bottom end of the extension rod 220. When the tent frame 100 is in the unfolded operational state, if the canopy at the top of the tent frame 100 is subjected to external forces (such as strong wind or rainwater accumulation), these forces are transmitted to the extension rod 220, creating a vertically downward pressure. This pressure causes the extension rod 220 to move downward within the first accommodating cavity 211. During this process, the second elastic member 260 is compressed and deformed, generating a vertically upward return force. This return force forms a dynamic balance with the downward pressure applied to the extension rod 220, effectively limiting the downward displacement of the extension rod 220 and maintaining the positional stability of the extension rod 220 in the deployed state. This buffering and balancing mechanism enhances the overall structural stability and safety of the tent frame 100 under harsh working conditions, reducing the risk of structural failure.

In other embodiments (not shown), a circular pressure-bearing plate with radial reinforcing ribs may be added at the contact point between the bottom end of the extension rod 220 and the second elastic member 260. This plate increases the contact area, evenly distributes pressure, and prevents localized stress concentration that could cause deformation or damage to the extension rod 220 or the second elastic member 260. Additionally, the edge of the pressure-bearing plate can be designed with a downward-curved flange, forming a guiding fit with the inner wall of the central main support rod 210. This ensures the extension rod 220 can smoothly move downward along the axis under high pressure, preventing jamming or lateral instability, thereby enhancing the reliability of the buffering mechanism.

In other implementations (not shown), the second elastic member 260 can be configured as a multi-stage elastic assembly structure, including a composite arrangement of a main spring and auxiliary damping components. The main spring provides the basic elastic return force, while the auxiliary damping components, such as rubber washers, damping cylinders, or hydraulic shock absorbers, are used to absorb instantaneous impact forces. This composite buffering structure offers dual-layer safety protection under extreme weather conditions like strong winds and heavy rain. It maintains structural positioning stability while effectively delaying the transmission of peak load impacts, thereby improving the overall disaster resistance performance of the tent frame.

In summary, the present disclosure achieves the following technical effects:

Through the plug-in structure of the central main support rod 210 and the extension rod 220, the longitudinal telescopic cooperation of the reinforcement assembly 200 is achieved, enhancing the overall structural rigidity and impact resistance of the tent frame 100 in the unfolded operational state. The first mounting base 212 and the second mounting base 213 are respectively arranged at the upper and lower parts of the central main support rod 210, featuring a plurality of mounting hole positions, which, in conjunction with the net-like support arm 130, form a multi-directional connection support network, effectively distributing forces evenly and improving the stability of the tent frame 100. One end of the first fastening rope 230 passes through the through hole 271 of the connection seat 270, while the other end is guided by the guide seat 214 into the first accommodating cavity 211 of the central main support rod 210, converging and connecting to the first elastic member 240 to form a vertical pre-tensioning structure. This structure provides continuous tension when the tent frame 100 is deployed, significantly enhancing the support stability of each corner post 110. The second fastening rope 250 is connected between the connection seat 270 and the fixed seat 223 of the extension rod 220, maintaining horizontal tension support in the deployed state, further optimizing the overall force distribution of the frame. The second elastic member 260 is installed in the first accommodating cavity 211, with its bottom end fixed to the second hanging rod 215 and its top end abutting against the bottom of the extension rod 220. When the tent top is subjected to downward pressure from rain or external forces, this elastic member 260 generates a vertical return force, forming a dynamic balance with gravity, effectively inhibiting the downward movement of the extension rod 220 and improving the deformation resistance and safety reliability of the tent frame 100 under complex working conditions.

The technical solution described in the present disclosure is not limited to the field of tents. Its core design, combining a central telescopic structure with multi-directional pre-tensioning cables for reinforcement, is equally applicable to frame systems requiring dynamic stability, structural reinforcement, and force buffering, such as outdoor sunshades, prefabricated temporary structures, and lightweight folding platforms.

In outdoor sunshade application scenarios, the reinforcement assembly can be positioned at the center of the sunshade or at the intersection of the support framework. By adapting the central main support rod 210 and the extension rod 220 as the main axial components of the sunshade structure, in conjunction with the multi-directional tension network formed by the first fastening rope 230 and the second fastening rope 250, as well as the vertical buffering return force provided by the second elastic member 260, automatic tensioning and positioning are achieved when the sunshade is deployed. This structure not only effectively improves the wind resistance stability of the sunshade but also reduces the frequency of manual adjustments during daily use, enhancing safety and convenience.

For prefabricated temporary structures (such as exhibition frames, portable shelves, foldable work platforms, etc.), integrating the net-like support arm 130 with mounting bases 212 and 213 at key junction points enables rapid connection and detachable stable support between a plurality of units. The active pre-tensioning mechanism formed by the first elastic member 240 and the central telescopic rod helps maintain force equilibrium in the frame structure when deployed; the dynamic buffering function provided by the second elastic member 260 can dissipate partial impact energy during equipment loading or external disturbances, preventing structural loosening or deformation, thereby enhancing the reusable lifespan and operational safety of temporary installations.

In lightweight foldable platforms or other frame equipment requiring rapid deployment and high stability, when this reinforcement assembly is used as a central support module, its multi-point cable linkage feature can provide stable support in both horizontal and vertical directions. Simultaneously, by adjusting cable lengths or replacing elastic member parameters, customized tuning of the platform's structural stiffness and adaptability can be achieved to meet safety requirements in diverse application environments (e.g., uneven terrain, high-wind operations, localized heavy loads).

In summary, the application and expansion of this technical solution can significantly enhance the frame stability, mechanical responsiveness, and environmental adaptability of various outdoor and temporary structural systems, effectively meeting differentiated demands for structural reliability and adjustability across different scenarios, with broad prospects for widespread adoption.

In the description of the present disclosure, it should be appreciated that directional terms such as "front, rear, up, down, left, right", "horizontal, vertical, perpendicular, horizontal" and "top, bottom" etc. indicate the orientation or positional relationship based on the orientation or positional relationship shown in the drawings, and are only for the convenience of describing the present disclosure and simplifying the description. In the absence of a contrary explanation, these directional terms do not indicate or imply that the device or element referred to must have a specific orientation or be constructed and operated in a specific orientation, and therefore should not be understood as limiting the scope of protection of the present disclosure; the directional terms "inside, outside" refer to the inside and outside relative to the contour of each component itself.

For the convenience of description, spatial relative terms such as "on . . . ", "above . . . ", "on the upper surface of . . . ", "upper" etc. may be used here to describe the spatial positional relationship of a device or feature with other devices or features as shown in the drawings. It should be appreciated that spatial relative terms are intended to encompass different orientations of the device in use or operation other than the orientation described in the drawings. For example, if the device in the drawing is inverted, the device described as "above other devices or structures" or "on other devices or structures" will subsequently be positioned as "below other devices or structures" or "under other devices or structures". Thus, the exemplary term "above" can include both "above" and "below" orientations. The device can also be positioned in other different ways (rotated 90 degrees or in other orientations), and the spatial relative descriptions used here should be interpreted accordingly.

In addition, it should be noted that the use of terms such as "first", "second" etc. to define components is for the convenience of distinguishing the corresponding components. Unless otherwise stated, the above terms have no special meaning, and therefore should not be understood as limiting the scope of protection of the present disclosure.

The above description is only a preferred embodiment of the present disclosure and is not intended to limit the present disclosure. For those skilled in the art, the present disclosure can have various modifications and changes. Any modifications, equivalent replacements, improvements etc. made within the spirit and principles of the present disclosure should be included within the scope of protection of the present disclosure.

What is claimed is:

1. A reinforcement assembly for a tent frame, comprising:

a central main support rod extending vertically, with a first accommodating cavity formed inside;

an extension rod slidably inserted into the first accommodating cavity;

a plurality of first fastening ropes, each with one end connected to a corner post of the tent frame and the other end extending into the first accommodating cavity and converging for connection;

a first elastic member positioned in a convergence area and connected to the extension rod, configured to generate a continuous pre-tension force when the tent frame is deployed, transmitting a tensioning force to the corner posts through the first fastening ropes to enhance frame stability;

a plurality of second fastening ropes, each connected between the extension rod and the corner post to form a horizontal tension network; and a second elastic member positioned at a bottom of the first accommodating cavity and abutting against the extension rod, configured to generate an upward return force when the extension rod is pressed downward by an external force from a canopy, dynamically counteracting a downward pressure and inhibiting displacement of the extension rod.

2. The reinforcement assembly for a tent frame according to claim 1, wherein a bottom end of the central main support rod is provided with a guide seat for forming a guide rail, and the first fastening ropes pass through the guide rail.

3. The reinforcement assembly for a tent frame according to claim 1, wherein a top end of the extension rod is provided with a fixed seat for forming a hanging hole, and one end of each second fastening rope is fixedly connected to the hanging hole.

4. The reinforcement assembly for a tent frame according to claim 1, wherein the extension rod is a cylindrical hollow tube, with a second accommodating cavity formed inside.

5. The reinforcement assembly for a tent frame according to claim 4, wherein the extension rod is provided with a first hanging rod that extends radially and penetrates the second accommodating cavity.

6. The reinforcement assembly for a tent frame according to claim 5, wherein the first elastic member and the second elastic member are helical springs.

7. The reinforcement assembly for a tent frame according to claim 6, wherein one end of the first elastic member is hooked to the first hanging rod, and the other end is connected to the first fastening ropes.

8. The reinforcement assembly for a tent frame according to claim 5, wherein the central main support rod is provided with a second hanging rod that extends radially along the central main support rod and penetrates the first accommodating cavity; and one end of the second elastic member is hooked to the second hanging rod, and the other end abuts against a bottom end of the extension rod.

9. The reinforcement assembly for a tent frame according to claim 1, wherein four first fastening ropes are provided and four second fastening ropes are provided.

10. A tent frame, comprising:

at least three corner posts extending longitudinally in a vertical direction;

at least three sets of transverse frame beams, each set of transverse frame beams slidably connecting two adjacent corner posts through a sleeve assembly; and a reinforcement assembly, comprising:

a central main support rod extending in the vertical direction, with a first accommodating cavity formed inside; and an extension rod slidably inserted into the first accommodating cavity; and a plurality of first fastening ropes, each with one end connected to a corner post of the tent frame and the other end extending into the first accommodating cavity and converging for connection; and a first elastic member positioned in a convergence area and connected to the extension rod, configured to generate a continuous pre-tension force when the tent frame is deployed, transmitting a tensioning force to the corner posts through the first fastening ropes to enhance frame stability; and a plurality of second fastening ropes, each connected between the extension rod and the corner post, forming a horizontal tension network; and a second elastic member positioned at a bottom of the first accommodating cavity and abutting against the extension rod, configured to generate an upward return force when the extension rod is pressed downward by an external force from a canopy, dynamically counteracting a downward pressure and inhibiting displacement of the extension rod;

wherein the tent frame further comprises at least three sets of net-like support arms, each set connecting the transverse frame beam and the central main support rod.

11. The tent frame according to claim 10, wherein the central main support rod is provided with a first mounting base and a second mounting base, and the net-like support arms are fixedly connected to the central main support rod through the first mounting base and the second mounting base.

12. The tent frame according to claim 11, wherein the first mounting base is slidably arranged on an outer surface of the central main support rod, and the second mounting base is fixedly embedded at a bottom of the central main support rod.

13. The tent frame according to claim 12, wherein the tent frame has an unfolded operational state and a storage state when collapsed;

when the tent frame is in the unfolded operational state, the first mounting base is positioned at a lower part of the central main support rod; and when the tent frame is folded from the unfolded operational state to the storage state, the first mounting base slides upward along the outer surface of the central main support rod.

14. The tent frame according to claim 11, wherein the first mounting base and the second mounting base are provided with mounting hole positions; and the net-like support arms are rotatably and fixedly connected to the mounting hole positions of the first mounting base and the second mounting base through bolt structures.

15. The tent frame according to claim 10, wherein a top of the corner post is provided with a connection seat, and the connection seat is provided with a through hole; and one end of the first fastening rope and one end of the second fastening rope are fixed to the through hole of the connection seat through a hook assembly.

16. The tent frame according to claim 10, wherein the corner post is configured as a telescopic tube structure, comprising: an outer tube, an inner tube, and a locking mechanism, wherein the inner tube and outer tube are fixed and locked at selected length positions by the locking mechanism.

17. The tent frame according to claim 10, wherein the transverse frame beam is axially positioned along the corner post through a snap-fit structure.

18. The tent frame according to claim 10, wherein four first fastening ropes are provided, and the bottom of the central main support rod is provided with a guide seat; and the guide seat is provided with four guide rails, and the first fastening ropes are threaded through the guide rails.

19. The tent frame according to claim 10, wherein the extension rod is a hollow cylindrical rod having an opening at a top thereof, and a fixed seat is embedded at the opening.

20. The tent frame according to claim 19, wherein the fixed seat is provided with a hanging hole, and one end of the second fastening rope is fixed to the hanging hole through a hook assembly.

* * * * *